US009168413B2

(12) United States Patent
Petrakis et al.

(10) Patent No.: US 9,168,413 B2
(45) Date of Patent: Oct. 27, 2015

(54) FITNESS AND TRAINING GARMENT

(75) Inventors: Lawrence Theodore Petrakis, San Francisco, CA (US); Anagnostis E. Zachariades, Hillsborough, CA (US)

(73) Assignee: ATHLOTEK LLC, Hayward, CA (US)

( * ) Notice: Subject to any disclaimer, the term of this patent is extended or adjusted under 35 U.S.C. 154(b) by 48 days.

(21) Appl. No.: 13/599,911

(22) Filed: Aug. 30, 2012

(65) Prior Publication Data

US 2013/0298301 A1 Nov. 14, 2013

Related U.S. Application Data

(60) Provisional application No. 61/529,783, filed on Aug. 31, 2011.

(51) Int. Cl.

| | |
|---|---|
| ***A41D 1/00*** | (2006.01) |
| ***A63B 21/065*** | (2006.01) |
| ***A63B 21/00*** | (2006.01) |
| *A63B 21/02* | (2006.01) |
| *A63B 21/055* | (2006.01) |
| *A63B 21/06* | (2006.01) |

(52) U.S. Cl.

CPC ..... *A63B 21/065* (2013.01); *A63B 21/1411* (2013.01); *A63B 21/1415* (2013.01); *A63B 21/1423* (2013.01); *A63B 21/1434* (2013.01); *A63B 21/023* (2013.01); *A63B 21/055* (2013.01); *A63B 21/0603* (2013.01); *A63B 21/0605* (2013.01); *A63B 2209/10* (2013.01)

(58) Field of Classification Search

CPC ..... A41D 27/04

USPC ..... 2/69, 115, 227, 79, 94, 108, 2.5, 97; 482/74, 105, 139

See application file for complete search history.

(56) References Cited

U.S. PATENT DOCUMENTS

| | | | | |
|---|---|---|---|---|
| 3,659,843 | A * | 5/1972 | Kojigian, Jr. | 482/139 |
| 3,759,510 | A | 9/1973 | Jackson, Jr. | |
| 3,777,309 | A | 12/1973 | Yeager | |
| 4,268,917 | A | 5/1981 | Massey | |
| 4,325,378 | A | 4/1982 | Wilkinson | |
| 4,344,620 | A | 8/1982 | Debski | |
| 4,382,302 | A | 5/1983 | Watson | |
| 4,384,369 | A | 5/1983 | Prince | |
| 4,394,012 | A | 7/1983 | Egbert et al. | |
| 4,407,497 | A | 10/1983 | Gracie | |
| 4,658,442 | A | 4/1987 | Tomlinson | |
| 4,684,123 | A | 8/1987 | Fabry | |
| 4,766,613 | A | 8/1988 | Wells | |
| 4,800,593 | A | 1/1989 | Ruffner | |
| 4,896,881 | A | 1/1990 | Djerdjerian | |
| 4,946,453 | A | 8/1990 | Monson | |
| 4,953,856 | A | 9/1990 | Fox et al. | |

(Continued)

OTHER PUBLICATIONS

EPO Search Report and Office Action in Appl. No. 13182480.7-1658, Dated Mar. 27, 2014.

*Primary Examiner* — Tejash Patel

(74) *Attorney, Agent, or Firm* — Edward S. Sherman

(57) ABSTRACT

A fitness garment or suit comprises at least one of a jacket or pants similar to an athletic truing suit. A detachable inner lining support various types of weights in distributed pattern about body portions, generally distributing the total load between joints to provide general fitness training while the user wears the suit throughout the course of their normal activities. The inner lining does not interfere with the drape and feel of the outer garment.

23 Claims, 16 Drawing Sheets

(56) References Cited

U.S. PATENT DOCUMENTS

| | | | | |
|---|---|---|---|---|
| 4,989,267 | A | 2/1991 | Watson | |
| 5,002,270 | A | 3/1991 | Shine | |
| 5,010,596 | A | 4/1991 | Brown et al. | |
| 5,033,117 | A | 7/1991 | Fairweather | |
| 5,048,125 | A * | 9/1991 | Libertini et al. | 2/79 |
| 5,075,902 | A | 12/1991 | McReynolds et al. | |
| 5,144,694 | A | 9/1992 | Conrad Da oud | |
| 5,182,812 | A | 2/1993 | Goldsby | |
| 5,190,511 | A | 3/1993 | Petree | |
| 5,205,815 | A | 4/1993 | Saunders | |
| 5,389,168 | A | 2/1995 | Litchholt et al. | |
| 5,503,919 | A | 4/1996 | Litchholt et al. | |
| 5,553,322 | A | 9/1996 | Cebo-Johnson | |
| 5,555,556 | A * | 9/1996 | Ozaki | 382/173 |
| 5,580,342 | A * | 12/1996 | Johnson | 482/105 |
| 5,659,898 | A | 8/1997 | Bell et al. | |
| 5,700,231 | A | 12/1997 | Wilkinson et al. | |
| 5,717,999 | A | 2/1998 | Lurry | |
| 5,728,032 | A | 3/1998 | Glass | |
| 5,745,925 | A | 5/1998 | Ghilardi et al. | |
| 5,755,110 | A | 5/1998 | Silvas | |
| 5,770,529 | A | 6/1998 | Dennis et al. | |
| 5,797,823 | A * | 8/1998 | Gouvis, II | 482/105 |
| 5,810,699 | A | 9/1998 | Nadeau et al. | |
| 5,842,959 | A | 12/1998 | Wilkinson et al. | |
| 5,893,223 | A | 4/1999 | Glass et al. | |
| 5,920,915 | A * | 7/1999 | Bainbridge et al. | 2/456 |
| 5,937,441 | A | 8/1999 | Raines et al. | |
| 5,943,700 | A | 8/1999 | Hammer et al. | |
| 5,951,446 | A | 9/1999 | Monforte | |
| 6,047,405 | A | 4/2000 | Wilkinson et al. | |
| 6,081,924 | A | 7/2000 | Ott | |
| 6,196,429 | B1 | 3/2001 | Cavdek et al. | |
| 6,209,135 | B1 * | 4/2001 | Irvin | 2/102 |
| 6,244,994 | B1 | 6/2001 | Tilberis | |
| 6,314,580 | B1 * | 11/2001 | Greenberg et al. | 2/108 |
| 6,364,851 | B1 | 4/2002 | Nafpliotis | |
| 6,520,926 | B2 | 2/2003 | Hall | |
| 6,557,176 | B2 | 5/2003 | Franco-Sion | |
| 6,669,608 | B1 | 12/2003 | Winston | |
| 6,671,887 | B1 | 1/2004 | Eligan et al. | |
| 6,692,413 | B1 | 2/2004 | Greenberg et al. | |
| 6,754,919 | B2 * | 6/2004 | Leaphart et al. | 5/417 |
| 6,834,396 | B2 | 12/2004 | Franco-Sion | |
| 7,000,255 | B1 | 2/2006 | Baacke | |
| 7,025,738 | B2 | 4/2006 | Hall | |
| 7,063,678 | B1 | 6/2006 | Cook | |
| 7,090,624 | B1 | 8/2006 | Chrishon | |
| 7,156,792 | B2 | 1/2007 | Gibson-Horn | |
| 7,376,979 | B2 | 5/2008 | Nilsen | |
| 7,490,361 | B1 | 2/2009 | Floyd | |
| 7,708,673 | B2 | 5/2010 | Gibson-Horn | |
| 2002/0010058 | A1 | 1/2002 | Myrick | |
| 2002/0189003 | A1 | 12/2002 | Babcock | |
| 2003/0019010 | A1 | 1/2003 | Franco-Sion | |
| 2003/0092544 | A1 | 5/2003 | Reed | |
| 2003/0106129 | A1 | 6/2003 | Kim | |
| 2003/0177984 | A1 | 9/2003 | Newman | |
| 2004/0000003 | A1 | 1/2004 | Franco-Sion | |
| 2004/0083529 | A1 | 5/2004 | Tate | |
| 2004/0147377 | A1 | 7/2004 | Gibson-Horn | |
| 2005/0096199 | A1 | 5/2005 | Egbert et al. | |
| 2005/0227833 | A1 | 10/2005 | Wilkinson | |
| 2006/0150295 | A1 | 7/2006 | Paternoster | |
| 2007/0000015 | A1 | 1/2007 | Alaniz | |
| 2007/0099775 | A1 | 5/2007 | Gibson-Horn | |
| 2007/0135279 | A1 | 6/2007 | Purdy et al. | |
| 2007/0256206 | A1 | 11/2007 | Nilsen | |
| 2009/0044310 | A1 | 2/2009 | Baacke | |
| 2009/0139005 | A1 | 6/2009 | Whaley | |
| 2010/0010568 | A1 | 1/2010 | Brown | |
| 2010/0064413 | A1 | 3/2010 | Koelle et al. | |
| 2010/0071113 | A1 | 3/2010 | Hamilton et al. | |
| 2010/0144490 | A1 | 6/2010 | Purdy et al. | |
| 2010/0218300 | A1 | 9/2010 | Alaniz et al. | |
| 2010/0248915 | A1 | 9/2010 | Gibson-Horn | |
| 2010/0311551 | A1 | 12/2010 | Winston | |
| 2011/0009713 | A1 | 1/2011 | Feinberg | |

* cited by examiner

FIG. 5A
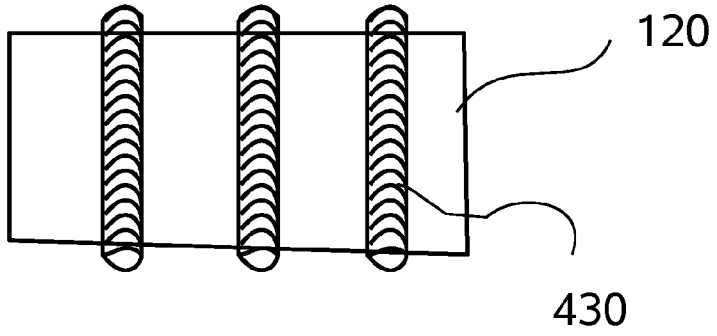
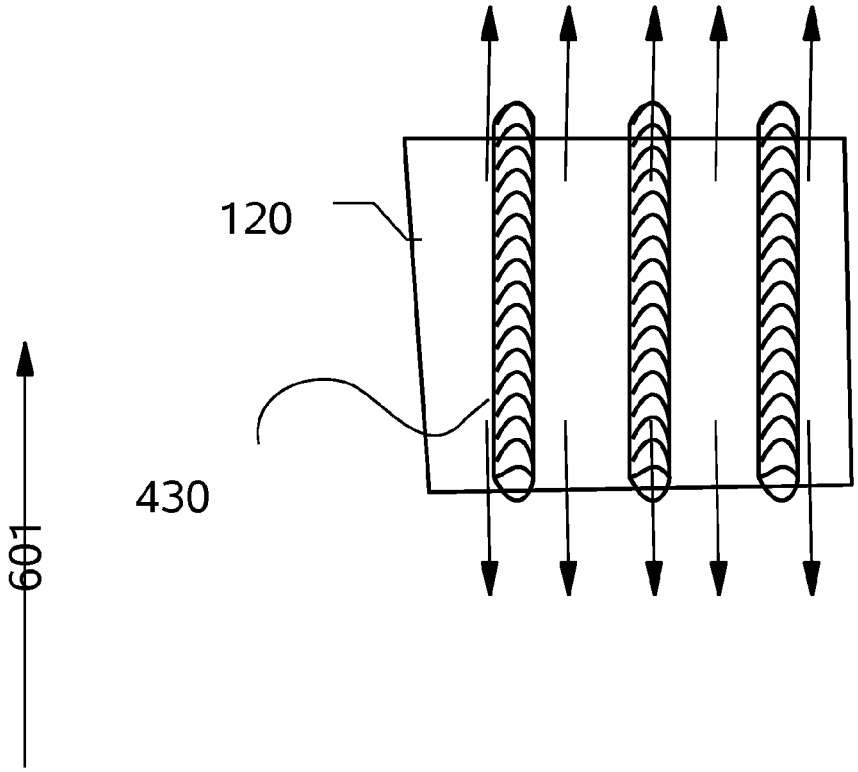
FIG. 5B

FIG. 12A
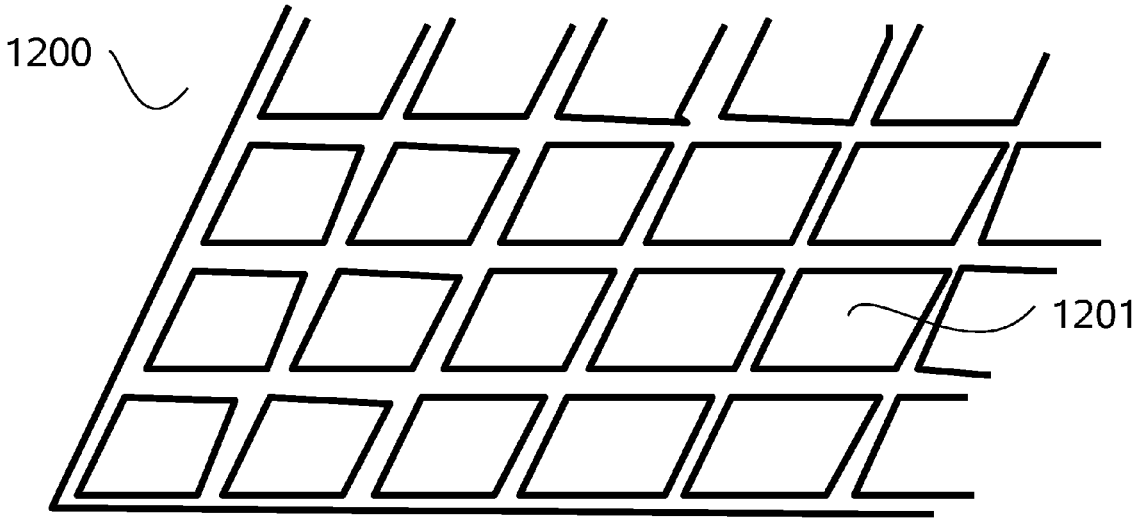
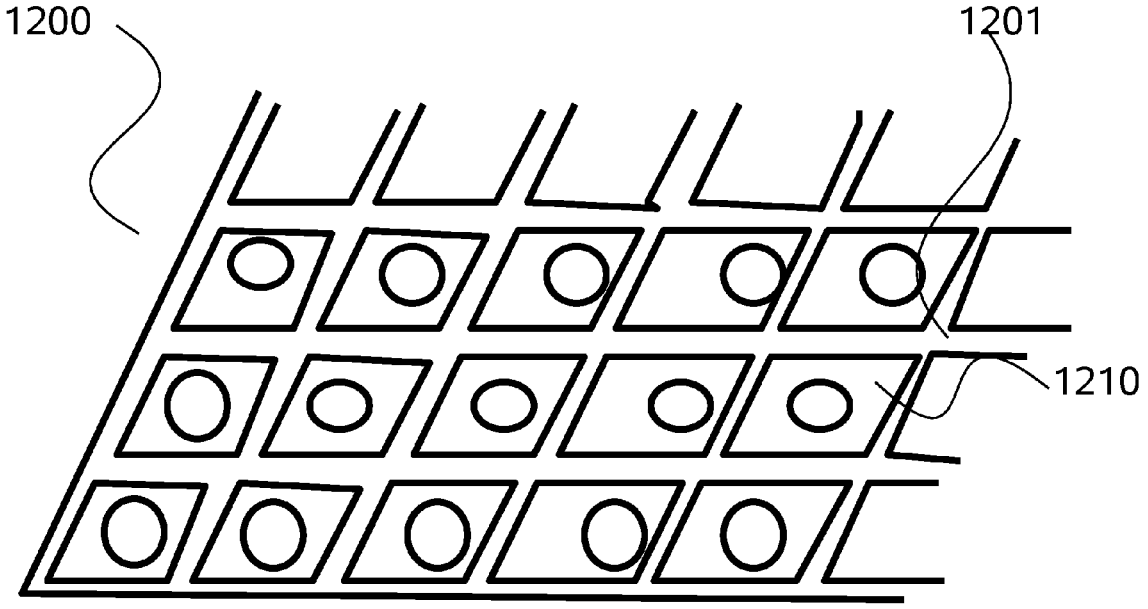
FIG. 12B

FITNESS AND TRAINING GARMENT

CROSS REFERENCE TO RELATED APPLICATIONS

The present application claims the benefit of priority to the US Provisional Patent application of the same title that was filled on Aug. 31, 2011, having application Ser. No. 61/529,783, and is incorporated herein by reference.

BACKGROUND OF INVENTION

The present invention relates to a weighted fabric material as well as garments made with such material and worn for therapeutic benefits and to increase athletic fitness and health.

There have been many proposals for exercise garments that have removable weights, with the intent to provide either a fitness aid without dedicating time to an exercise routine or as a training aid for athletes. Such garments are believed to facilitate a gradual increase in strength and bone mass as the weight or load carried by the user s gradually increased. However, these designs have not been commercially successful.

Today's lifestyles and working conditions most often compromise the average person's will to engage in and maintain physical exercise programs, the lack of which can lead to long term dysfunctions and health problems.

In modern societies physical fitness is commonly pursued through various repetitive exercises such as weight lifting routines and cardiovascular exercises done for specific time intervals using different devices and machines for strengthening and moving particular parts of the human body. These exercises require discipline as well as an extended and maintained time investment, both of which can be difficult commitments for an individual to make. Moreover, these activities entail prudence the duration and intensity level of the exercise in order to attain a desired level of fitness without incurring injuries particularly when they are not conducted on a regular basis. Physical fitness becomes a serious problem for older people who, as they age and lose their sense of security and physical capability, tend to withdraw to inactivity.

It is a object of the invention to provide an exercise garment that is useful for both general physiological conditioning as well as a training aid that provide the general advantages of being a garment that is easy to wash and maintain, as well as to provide the user with a normal appearance.

It is a further object of the present invention to provide such an exercise garment that is also comfortable to wear.

It is a further object of the present invention to provide such an exercise garment weight loading and weight distribution.

It is a further object to provide such a garment with appropriately placed weights and other strengthening devices to treat specific medical conditions.

SUMMARY OF INVENTION

In the present invention, the first object is achieved by providing a wearable garment system that comprises an outer shell fabric adapted to fit at least one of a person's leg and the torso and arms, an inner lining detachable from the outer shell weights that are coupled to the inner lining or are part of the inner lining, wherein the weights are distributed in multiple position between at least the joints of limbs and the torso so as to not interfere with the drape of the outer shell in the absence of the inner lining.

A second aspect of the invention is that in this wearable garment system, the weights are a plurality of metallic springs or metallic components of suitable shape, form and function.

Another aspect of the invention is characterized in that this wearable garment system has an inner lining is an elastic fabric.

Another aspect of the invention is characterized in that this wearable garment system has a soft foam padding layer between the inner layer and the outer shell and at least partially covering the metallic springs or other metallic components.

Another aspect of the invention is to provide a weighted fabric for making an exercise garment that is useful for both general physiological conditioning as well as training The above and other objects, effects, features, and advantages of the present invention will become more apparent from the following description of the embodiments thereof taken in conjunction with the accompanying drawings.

BRIEF DESCRIPTION OF THE DRAWINGS

FIGS. 5A and B illustrate how springs can expand with the elastic fabric in uniaxial stretching in which FIG. 5A shows the un-stretched state, and FIG. 5B is the uniaxially stretched state FIG. 6A-C illustrates how springs can expand with the elastic fabric in biaxial stretching in which FIG. 6A shows the un-stretched state, and FIG. 6B the uniform biaxially stretched state and FIG. 6C the non uniform biaxially stretched state.

FIG. 8A-C illustrate further details of the button or disc supporting construction, in which FIG. 8A is an cross-section elevation of a button before attachment to a surrounding fabric tube, FIG. 8B is a plan view of the fabric tube as attached to the elastic fabric, and FIG. 8C is a cross-sectional elevation of the button/disc and attached tube taken at FIG. 8B at section line C-C.

FIG. 9A-C illustrate further details of an alternative button or disc supporting construction, in which FIG. 9A is an cross-section elevation of a button before attachment to a surrounding fabric tube, FIG. 9B is a plan view of the fabric tube as attached to a surrounding fabric tube, FIG. 9B is a plan view of the fabric tube as attached to the elastic fabric, and FIG. 9C is a cross-sectional elevation of the button/disc and attached tube taken at FIG. 9B at section line C-C.

FIG. 11A is a schematic exploded perspective view of another alternative elastic fabric, whereas

FIG. 12A is a schematic perspective view of another alternative fabric for use in the invention, whereas FIG. 12B illustrates the same fabric filled with weight elements.

FIG. 14A-C illustrate various components and the construction of a woven fabric that comprises tubular threads with the weights in their tubular lumen, in which FIG. 14A is schematic perspective view of such a woven fabric, FIG. 14B is a cross-section elevation view of the tubular threads in FIG. 14A, and FIG. C is a cross-sectional elevation of an elastic fabric construction that deploys the woven fabric in FIG. 14A.

FIG. 15A-C illustrate various components and the construction of a non woven porous membrane with the weights encapsulated by the membrane, in which FIG. 15A is a partial cut-away plan view of a portion of the fabric corresponding to the cross-sectional elevation in FIG. 15B, whereas FIG. 15C is a cross-sectional elevation of an alternative construction.

DETAILED DESCRIPTION

Figures 1A, 1B:
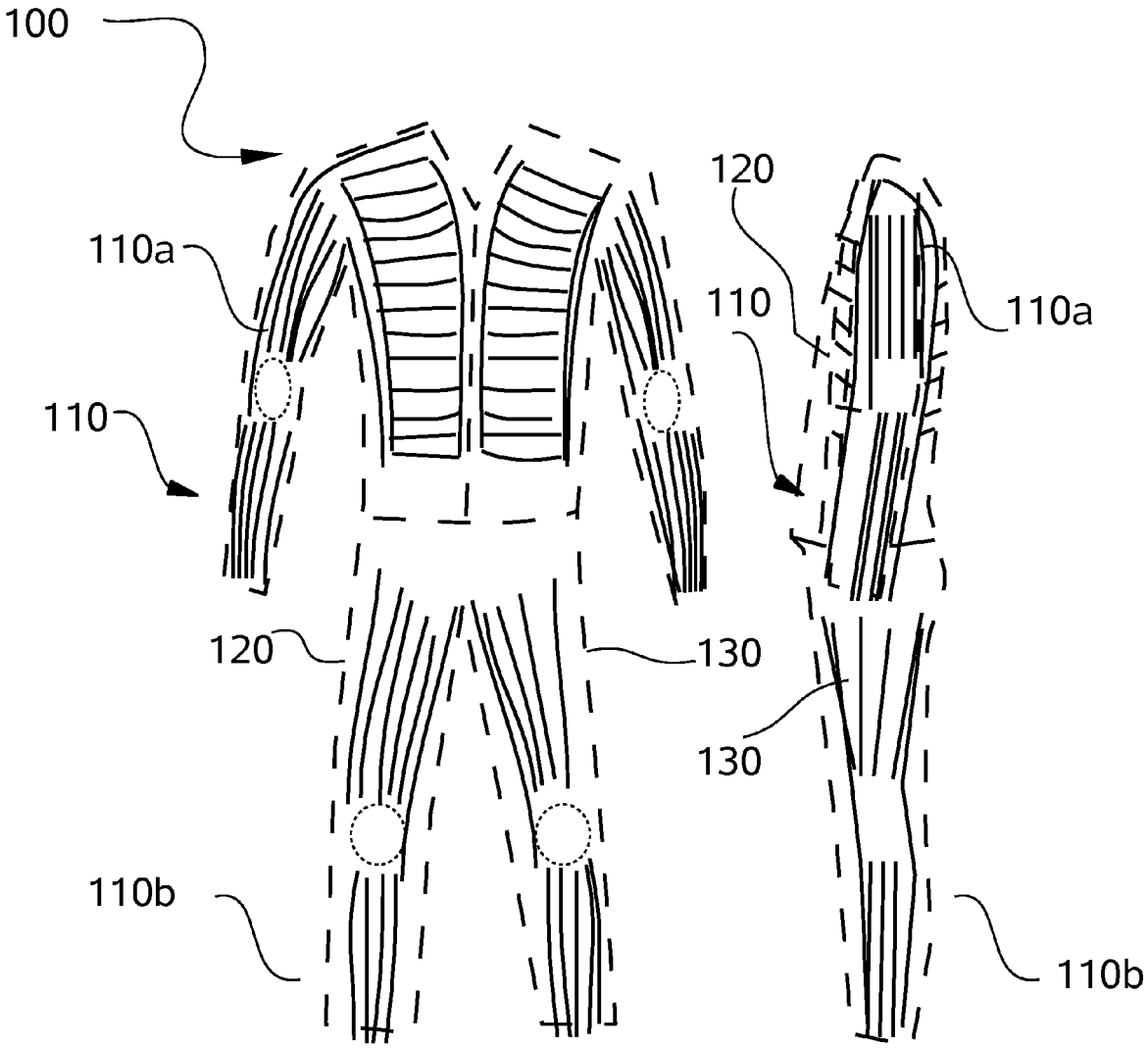
FIG. 1A front elevation view of a first embodiment of the invention.
FIG. 1B side elevation view of a first embodiment of the invention.

Referring to FIGS. 1 through 16, wherein like reference numerals refer to like components in the various views, there is illustrated therein a new and improved fitness and training garment, which is preferably made of a fabric material also disclosed in this application, the garment generally denominated 100 herein.

Hence, according to the various embodiments disclosed herein in further detail, one aspect of the invention is a weighted cloth material composition comprising a fabric exhibiting elasticity so that it fits snuggly over the body surface that it covers when it is worn and incorporating an additional solid or liquid component that is dispersed on the surface of the elastic fabric in order to distribute the weight of the solid or liquid components uniformly over the whole surface of the fabric.

Another aspect of the invention is an athletic suit or training garment 100 made of the weighted cloth material with the above characteristics which when worn distributes the weight of the weighted cloth uniformly over the human body and give the user the opportunity to exercise the entire body through normal daily activities.

A further aspect of the invention is that the athletic suit or training garment 100 made of the weighted cloth material with the above characteristics which can be attached as an under-layer to regular garments such as a jacket or pants so that it can be worn inconspicuously and used to enhance the fitness building properties of daily activities.

A further aspect of the invention is that the invention is a garment or any part of a garment such as a sleeve or a pant leg made of the weighted cloth material with the above characteristics which when worn during rehabilitation exercises for example, or for other specific muscle training purposes, will enable the targeted, precise, and uniform distribution of weight over the desired area of application.

Hence, the various embodiments of the cloth of this invention is a gravity assist product that can be thought of as a weighted veil that covers the human body snuggly and is worn like an athletic warm up suit. A suit made with the cloth or fabric of this invention can be useful to individuals such as athletes who seek to improve their performance, people in rehabilitation who seek to regain their strength and mobility, or aging people who seek to enhance their muscular and cardiovascular fitness through everyday tasks and routines. The way an athletic suit that is made with the gravity assist cloth material of this invention works is by simulating a heavier body weight condition for the wearer, that demand higher energy levels for any given activity. This will lead to improved muscular and cardiovascular conditioning for the same tasks and body movements that user already performs through daily life routines. For example, a person of advanced age weighing 70 kg can uniformly add 5% of his normal body weight to his existing body weight by wearing a suit made of the gravity assist cloth of this invention. This will bring the person's total weight to 73.5 kg. The user can then "train" by walking up the staircase in his house as part of his daily needs, or performing other daily chores/tasks. In so doing, the user will increase his fitness with little/no hindrance to his daily routine, and will be able to execute these same tasks with increased facility when shedding the extra 5% weight of the gravity clothing and changing into regular clothing. Similarly, a runner training at a more demanding energy level with an additional weight of e.g. 10% his normal weight distributed uniformly over his body's surface by way of the gravity clothing will run faster or more effortlessly when he competes at his normal body weight. The even distribution of weight will enable the athlete to train at a higher level of uniform resistance and simulate normal body kinetics. Alternatively, one can chose to target specific muscles or muscle group with the use of this distributed load material by applying it in customized fashion to specific areas of the body to perform specific tasks.

It should be noted that while the prior art shows various weight jacket devices for supporting weights for training purposes, none of these devices address or even attempt to distribute the weight uniformly over the body, but also lack other important properties beneficial to obtain the maximum benefit in the intended use, as for example body conformity, breathability, comfort among others. For example, US Patent Appl. No. 2009/0139005A1 describes a weighed exercise clothing in which weights are placed in ways that the weights do not interfere with body movements. U.S. Pat. No. 7,490,361 describes a vest that includes a plurality of pockets for holding weights. US Patent Appl. No. 2003/0092544A1 describes a non stretchable device with pouches for holding weights. U.S. Pat. No. 5,937,441 describes a suit with weight compartments about the body in which weights can be installed. None of the above examples of the prior art address the issue of weight distribution and uniformity over the wearer's body surface, which is a important feature of this invention that preferably also provides a unique combination of several other practical features such as body conformity, comfort, breathability, washability, foldability, and ease of use.

The inventive athletic suit made of various embodiments of the "gravity assist" cloth is practical, portable and discrete and, very important, it is designed to allow the user to exercise through normal daily routines and body motions. The weight level of a training suit can be varied according to the physical fitness and condition of the user. Once a specific training or fitness level is mastered, the user can increase the bar of the "body weight condition" by wearing a suit made with a heavier cloth of this invention.

Figure 2:
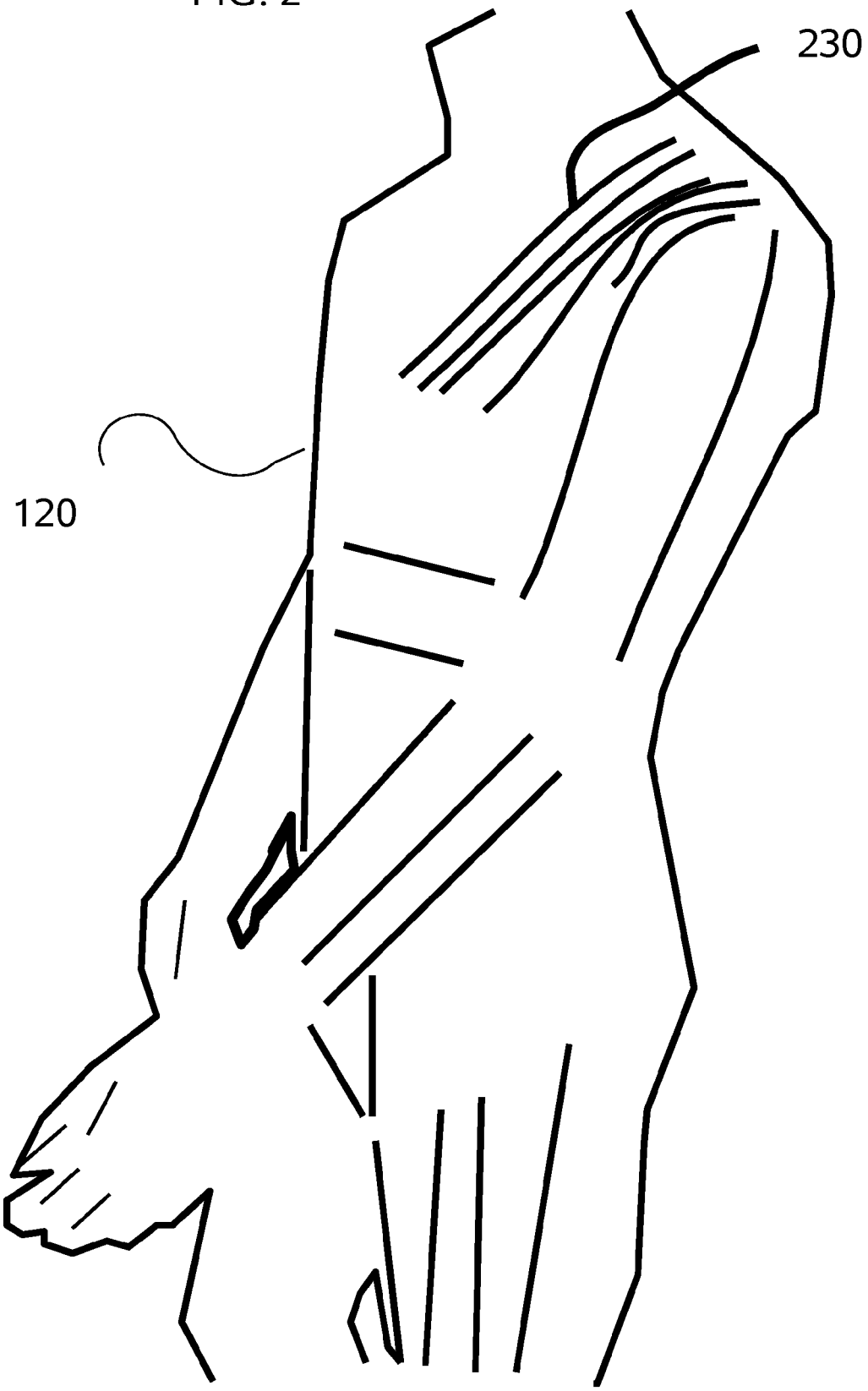
FIG. 2 is a perspective view of a second embodiment of the invention.

In accordance with one aspect of the present invention, FIG. 1 illustrates an embodiment in which a wearable garment 100 has an outer shell 110, and a inner lining 120 detachable from the outer shell, the inner lining preferably being an elastic fabric and also preferably deploying detachable weights 130 coupled to the inner lining 120. The inner lining 120 is preferably a weighted elastic fabric or "gravity assist" cloth according to the embodiments described in more detail below with respect to FIG. 4-14. FIG. 2 illustrates in perspective view an inner garment 120 having a plurality of closed spaced linear weight members, such as springs, wires, cable and the like, which are preferably connected to the elastic fabric component of the "gravity assist" cloth as further described below with respect to FIG. 4-6.

The inner garment 120 is preferably attached to the drapeable outer garment 110 by a plurality of coupling means 140 that are distributed at different locations to permit the inner and outer garments to be removed together as a unit. That is, although the inner garment 120 will fit snugly to the body, it is preferably removed easily as a single unit as the wearer removes the outer garment 110, as the coupling means 140 are of sufficient strength and number to enable the outer garment to peel away the inner garment as it is removed, without the wearer appearing to be wearing anything other than the outer garment. The outer garment can be styled as an athletic suit or other socially acceptable outer wear.

A shown schematically in FIGS. 1A, 1B and 2, the linear metal springs 230 are aligned in certain directions in different parts of the suit, e.g. along the length of the arms or legs or circumferentially below the chest line for comfort and flexibility. The spring cables can be attached directly onto the fabric, e.g. by sewing, fastening or piping them in the fabric, that is sewing the fabric around the linear metal springs into pipes or tubes. Alternatively they can be attached onto elastic fabric pieces/panels that can mounted on the suit by zippers, "Velcro™" or other means. Some of the advantages of such an arrangement are their replacement with fabric panels of different weight and their removal for washing purposes. FIGS. 1A and B also show the incorporation of a jacket 110*a* and pants 110*b* (in interrupted lines) that can be used with or conceal the underlying training or gravity suit 100. In particular, circumferential alignment of the spring cables about the upper body core can be useful in exercising the intercostal muscles, which are difficult to exercise, for helping people with respiratory problems. The springs 230 which can be used for this purpose can have different initial tension and stiffness and used in different densities to provide different levels of tension forces. For example, 10 springs with diameter about 3.18 mm, an initial tension 0.2 kg and a spring constant 322 N/m can provide a total initial tension of 2 kg.

It should be appreciated that the garment 100 can be a jacket, pants, jacket and pants and a one piece suit, and the like. Inner garment 120 is optionally a sleeveless vest, but also preferably has a front opening at the same location as the outer garment 110. It is generally convenient if the opposing sides of such a vest attached in the front with a zipper.

Figure 3:
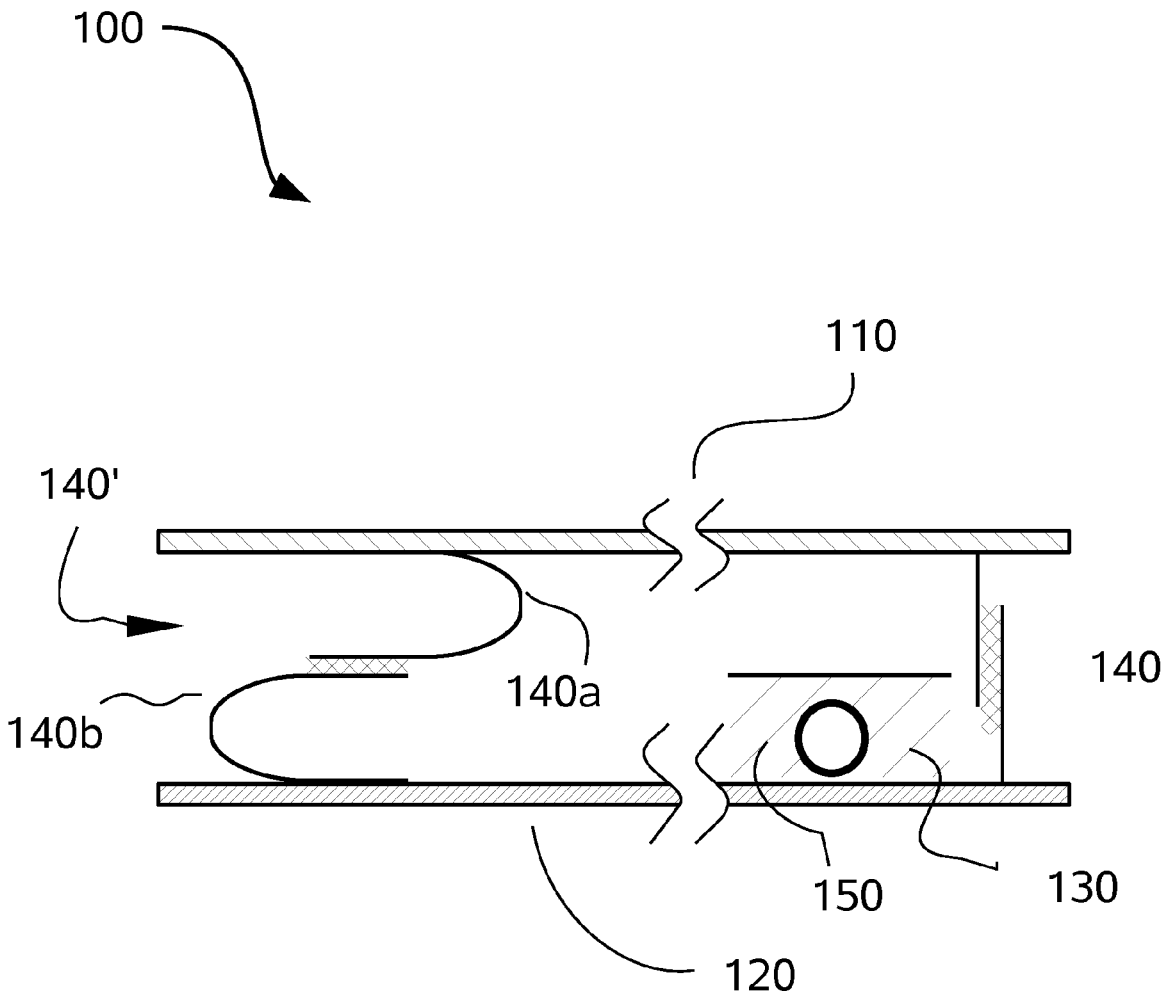
FIG. 3 is a cross sectional elevation of a portion of the inner and outer garments to schematically illustrate a means for detachable coupling.

FIG. 3 illustrates an attachment or coupling means 140 that connects the inner 120 and outer garment 110 in the space between, which enables the user to vary the proximity of the inner and outer garments at selected locations to improve the feel and fit of the inner and outer garments. The inner garment 120 can be detached from the outer garment 110 for washing. The inner garment 120 is preferably an elastic fabric to provide a close fit with the user's/wearer's body. Coupling means 140 can have different lengths to provide the desired slack in select areas of the garment to give the outer garment 110 a drapeable appearance, if desired. Coupling 140', for example has a portion 140*a* that is attached to the inner garment 120 and another portion that is attached to the outer garment 110, with parts 140*a* and 140*b* being connected to retain the outer garment 110 on the user's body. The parts 140*a* and 140*b* of coupling means 140' and 140 can be flat flexible fabric ribbons, cords, straps and the like, the length of which determine how tightly the adjacent portion of the outer garment 110 fits to the inner garment 120, to optionally provide a draped appearance of the outer garment. The means for connecting coupling portions 140*a* and 140*b* can be hook and loop style fasteners ("Velcro®"), buttons, zippers, clips, snaps and the like. To the extent a non-elastic portion of the inner garment 120 provides a normal drape, the coupling distance can remain relatively constant.

The couplings, such as 140' that are longer will of course extend to tighten so that the under garment or lining is removed with the outer garment The weights 130, being attached to the inner garment 120, which are preferably at least partly elastic to draw the weights 130 close to the body, also preferably do not interfere with the drape of the outer garment 110 and its breathability. The weights 130 can be distributed between primary body joints and the body core on a detachable shell or smaller supports that then attach to the inner garment 120.

The conformity of inner garment 120 to the user's body, provides fitness improving benefits, while the normal appearance of the outer garment 110 provides the aesthetic benefits that encouragers the user to wear the garment system 100 for most of the day, obtaining the greatest level of fitness conditioning.

However, the couplings 140 should be provided in sufficient density that stress between the inner 120 and outer 110 garments at each location will be minimized such that the removal of the outer garment also extends the elastic inner garments pulling it way from the body.

So as to produce a normal drape of the outer garment on the wearer, some of the couplings draw the adjacent portions of the two garments close together, say for example at the shoulders, were as others, as for example the torso and arms have a flexible length of material separating the inner and outer garments to provide a normal drape to the outer garment.

It should also be understood that the inner garment 120 can be elastic to fit to the user's body in the weight carrying portion and not others. The non weight bearing portion of the inner garment can provide the "slack" necessary for the free draping of the outer garment. Thus, providing such slack in a non elastic portion of the inner garment can be equivalent to providing a combination of different loose coupling means 140' and 140.

Figure 4:
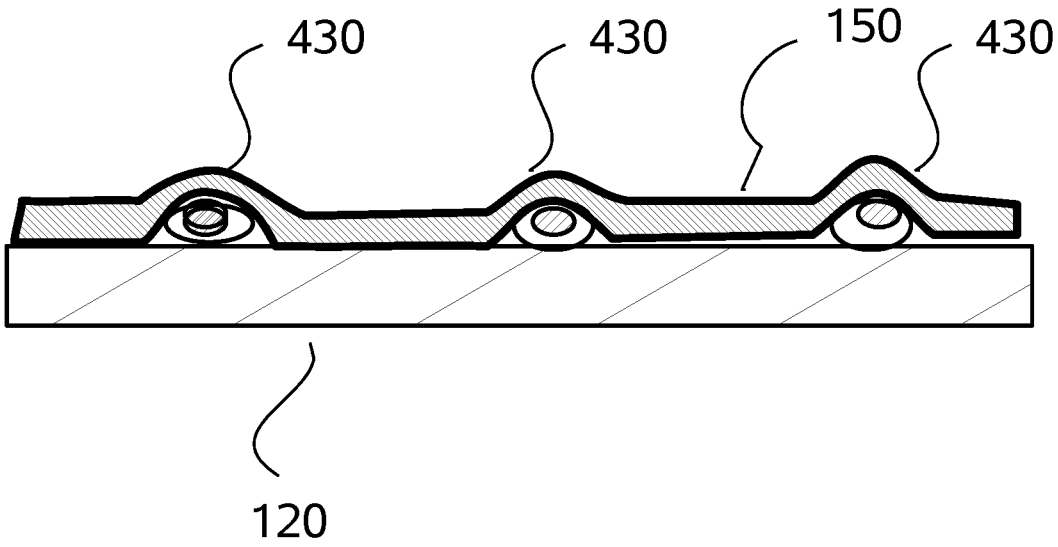
FIG. 4 is a more detailed cross sectional elevation of a portion of the inner garment to illustrate an embodiment of a means for providing spring as weights thereon.

FIG. 3 also illustrates a more preferred embodiment of the weights 130 and padding 150 that are disposed between the inner and outer garment so that when the outer garment 110 is removed, the visible portion of the lining has a rather normal appearance. Further, the padding makes the inner garment 120 more comfortable to wear, as the size or density of the weights increases. FIG. 4 illustrates in cross-section an inner garment 120 in which the weight element 130 is a plurality of coiled springs 430.

Whatever the approach, it is important that the weight of the elastic fabric that forms the inner garment 120 is distributed uniformly over the body surface area that it is intended to cover and within certain thickness limits so that the cloth fabrication is comfortable, breathable, unobtrusive and conformable to the body lines and easy to use.

The weight of the elastic fabric or gravity cloth 120 can be customized for specific groups of users, for example, athletes, rehabilitating patients, older people. Athletes may tolerate and prefer cloth fabrications of heavier loads whereas rehabilitating patients and aged people lighter weights. Beyond their weight and other characteristics described above, the gravity cloth fabrications preferably exhibit other attributes, for example, have long fatigue life times upon bending and folding and are washable.

FIG. 4 illustrates another embodiment of the inner garment 120 primarily formed of an elastic fabric with foam padding 150 between and around weights 430 in the form of coiled springs such that the weights and padding are attached to the inner garment 120. Either flat foam or an additional fabric layer can be provided to urge the weights 430 against the inner garment 120. The padding 150 is preferably disposed in the shell or inner lining or garment 120 to distribute load of the weights 130 or springs 430 on hips or shoulders of the user. As the foam padding 150 and/or any covering over it is stitched to the elastic fabric that forms the inner garment 120, the springs 430 preferably deform with the elastic fabric as shown in FIGS. 5AB and 6A-C. Such springs 430, are also shown for weights 130 in FIG. 1A-B, and FIG. 2 (230) and disposed in the linear direction on body limbs and disposed generally radially around the torso and can be deployed around joints to provide additional resistance training or orthopedic treatment. The novel arrangement also disposes the weights and any protective padding between the inner and outer garments where they are less likely to become soiled, and hence would be detached for machine mashing, or if soiled then separately detached for hand washing. Hand washing avoids potential damage to delicate weights, such as coiled springs, as well as damage to laundry machine or equipment or other articles in the wash load from heavy buttons and the like.

Figure 6A:
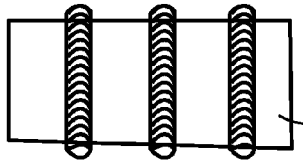
Figure 6B:
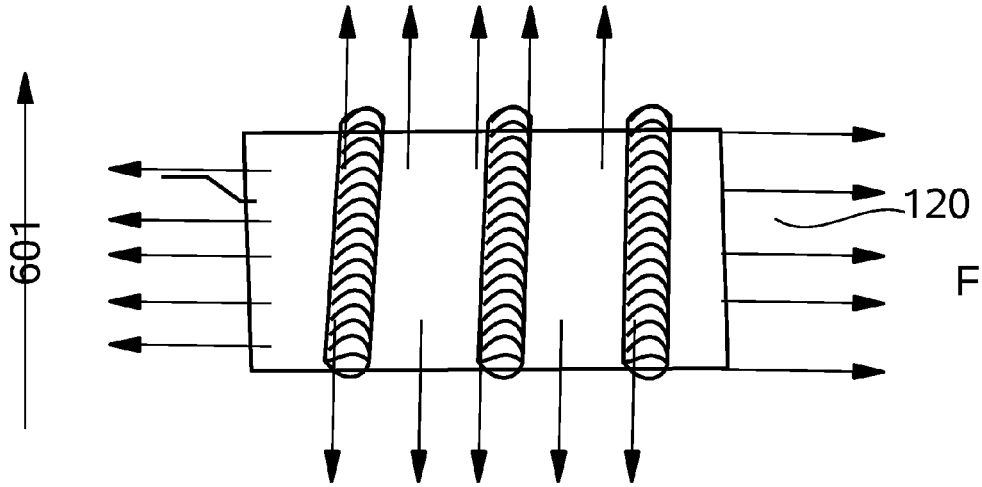

FIGS. 5A and 6A schematically illustrates in plan view a portion of the elastic fabric and springs 430 of the inner garment 120. When the springs 430 are small and have comparable elasticity and compliance elastic fabric of the inner garment 120, they readily stretch with it in the same direction, such as along arrow 601 in FIG. 5B. However, as shown in FIGS. 6B and 6C, the fabric can also be biaxially stretched, that is simultaneously stretched to expand in the direction of arrows 601 and 602 that are orthogonal to each other.

Figure 6C:
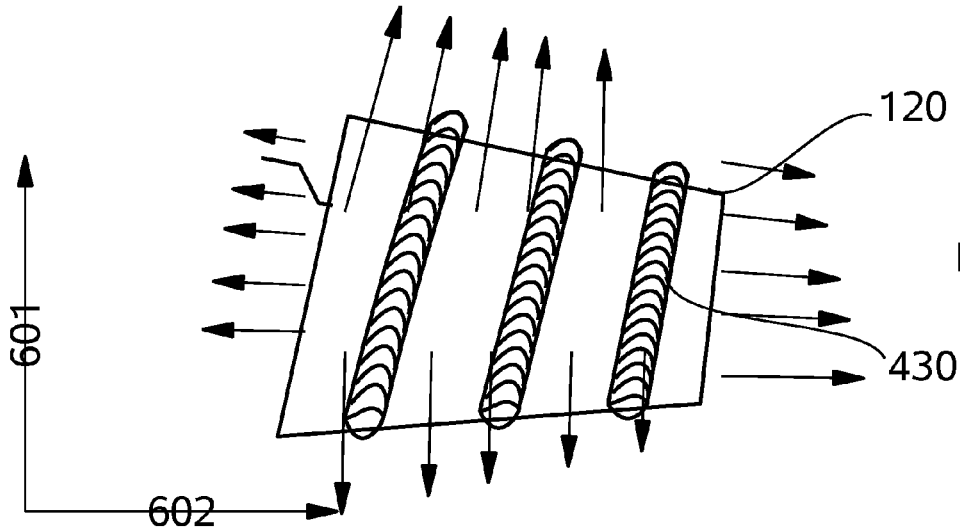

Further, as shown in FIG. 6C, when the elastic fabric is bi-axially extended in the planar directions with simultaneous torsion the linear metal springs deform to the same extent and along the same deformation path. As such deploying a plurality of integrally attached small metallic spring according to the examples and preferred embodiments of the invention does not diminish the general freedom of the elastic fabric to stretch, bend, and fold in different directions. Upon release of the stretching, both the linear metal springs and the elastic fabric return to their initial un-deformed state. Further details of such a structure are provided in example 4.

Preferably, as discussed further below, a large number of small springs are also provide a relatively uniform weight distribution over the inner garment 120. Elastic fabric can be formed from woven elastic fibers, non woven elastic fibers and/or sheets of elastic materials, as well as a convention fabric using the foam elastic portions to provide conformation to the wearer's body.

Figure 7:
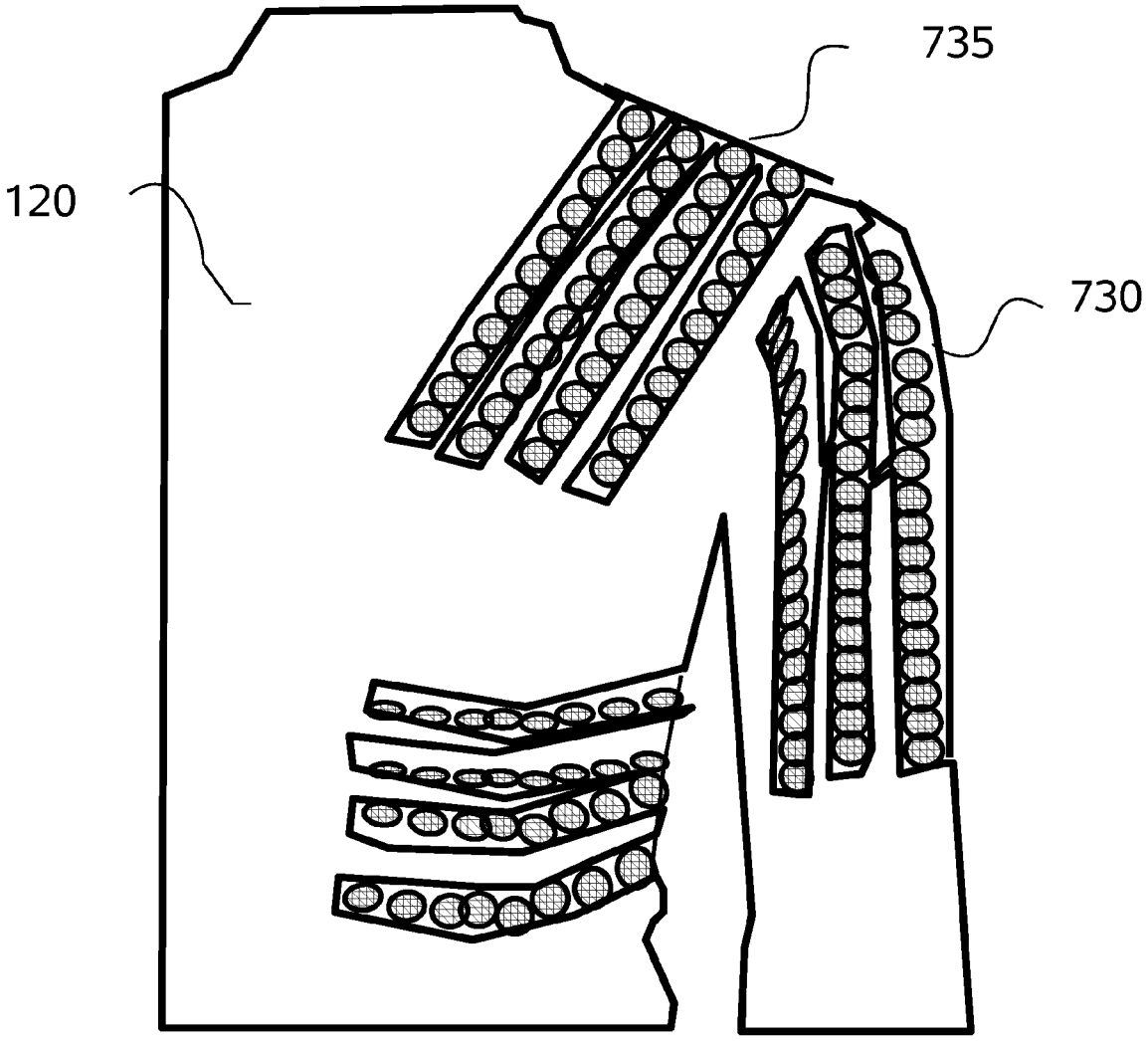
FIG. 7 is a front elevation of another embodiment in which the weights are discs or buttons.

Additionally, weights 130 can also be deployed as detachable buttons 730 shown in FIG. 7. The weighted buttons 730 are readily detached from the inner garment when attached in rows to common ribbons 735. The common ribbons 735 can be removed from button holes in the inner garment 120. The common ribbon 735 is also preferably an elastic fabric so that is stretches with the inner garment 120. The elastic ribbons 735 may deploy external buttons for attachment to the inner garment, as well as internal metal buttons to provide weight.

Figures 8A, 8B, 8C:
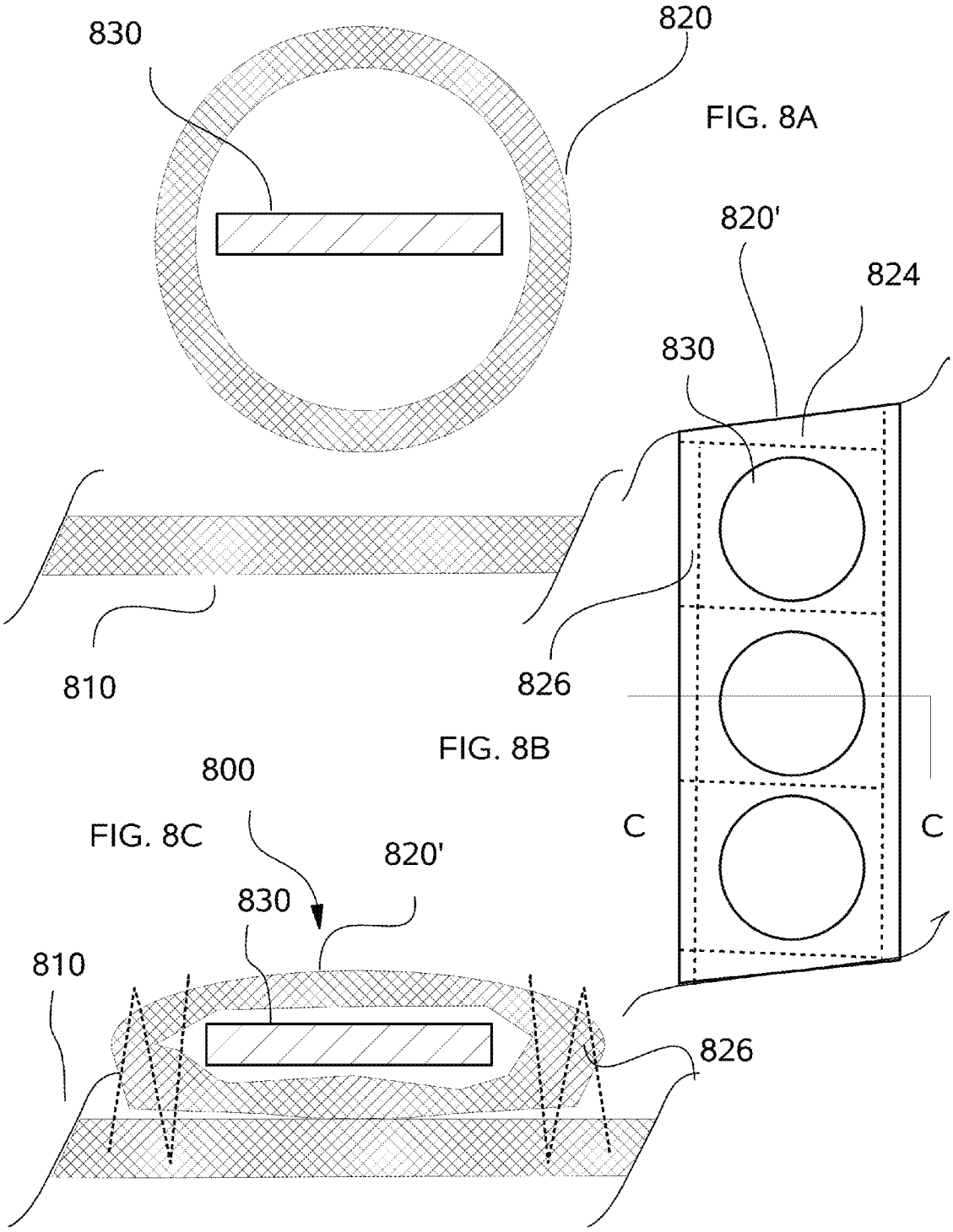

FIGS. 8A-C and 9A-C illustrate a method of forming such common ribbons 735 in which the metal disc or buttons 830 are held in elastic fabric tubes 820, which are flattened into tapes or ribbons as shown in FIG. 8C either before or when attached to the elastic fabric supporting layer 810.

Alternatively, as shown in FIGS. 8A-C and 9A-C and corresponding to Example 3 below, the weighted button or discs 830 are optionally more integrally attached to the elastic fabric when the ribbon 820' holding the weights is stitched into the elastic fabric 810, rather than being periodically attached to it via buttons of other detachable means. As shown in FIG. 8A, the buttons 830 are optionally first placed within elastic fabric tubes 820 of at least about the same inner diameter as the button or discs outer diameter. The fabric tube is flattened vertically to form a ribbon 820', illustrated in plan view in FIG. 8B. Cross stitching 824 holds each button 830 in place in the tube 820, as well as essentially flattens the tube 820.

Figures 9A, 9B, 9C:
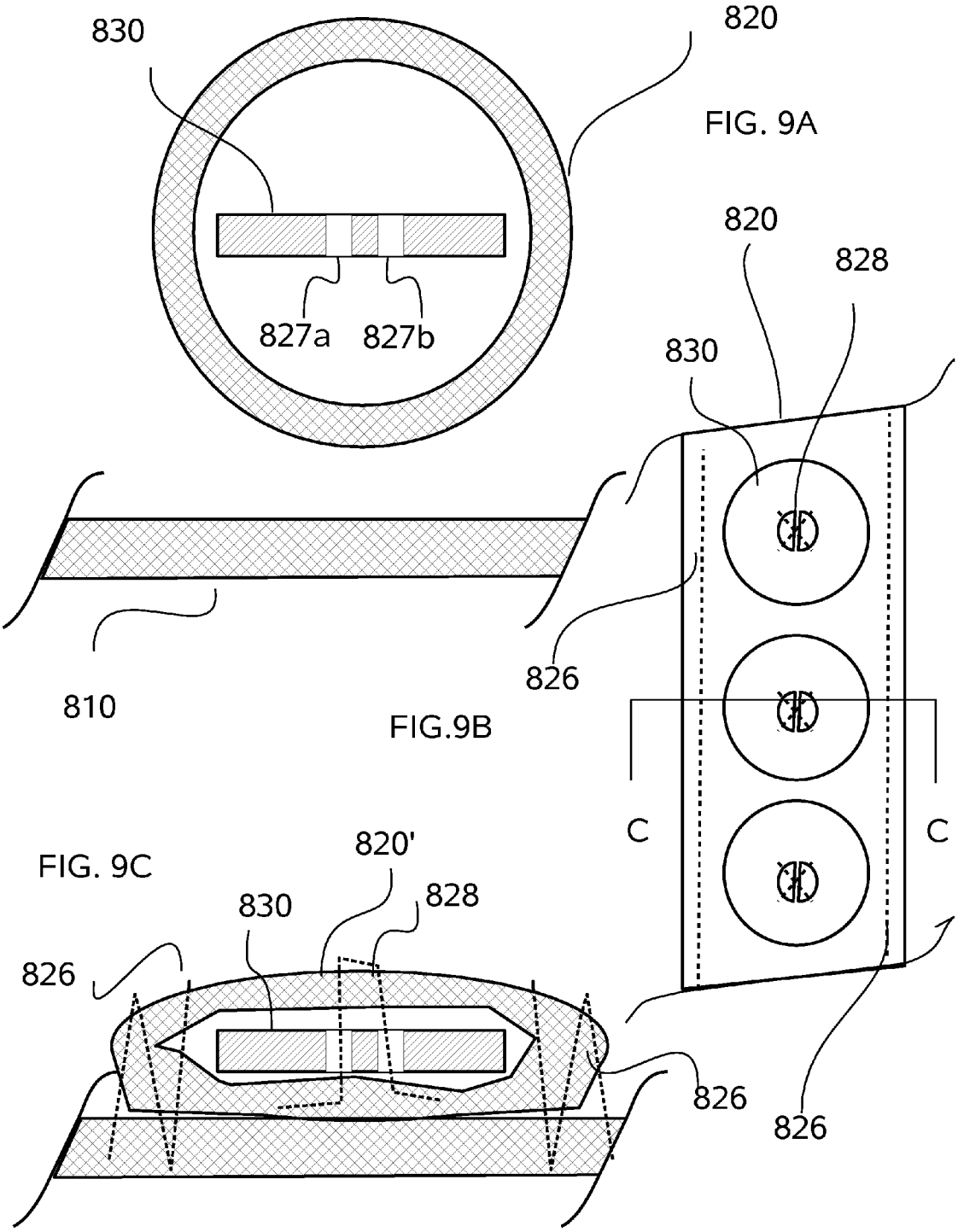

This ribbon 820' is then alternatively attached to the elastic fabric as shown in FIG. 7, or as shown in FIGS. 8C and 9C, in which it is integrally attached to the elastic fabric 800 by stitching 826 along the tube or ribbon length to form elastic weight fabric 800.

FIG. 9A-C illustrates an alternative to the embodiment of FIG. 8A-C in which each button 830 now has a pair of adjacent central holes 827*a* and 827*b* allowing the attachment to the tube with conventional button stitching 828 to tube 820. The button supporting ribbon 820' in then integrally attached to the elastic fabric 810 by stitching 826 along the tube or ribbon length to form elastic weight fabric 800.

Figure 10:
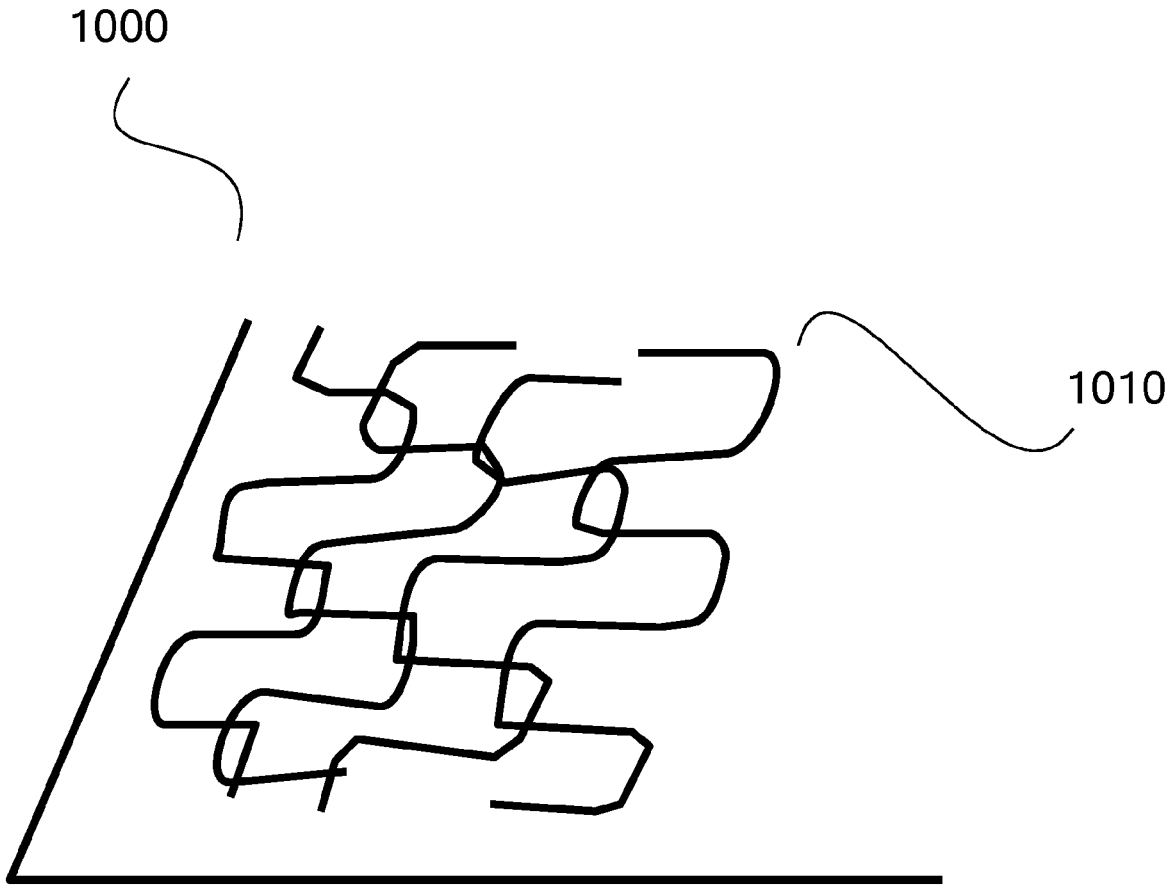
FIG. 10 is a schematic perspective view of an alternative elastic fabric for use in the various embodiments of the invention.

Other examples of unique fabrics adopted to provide uniform weight distribution in the instant invention are illustrated in FIG. 10-13. Thus, FIG. 10 illustrates in a schematic perspective view an alternative fabric 1000 for the inner garment 120, in which the elastic fabric 1000 includes a zig-zag overlapped weaving of heavier synthetic fiber or metallic fibers 1010 in a square wave pattern that overlap in a manner that permits limited expansion and compression.

Figure 11A:
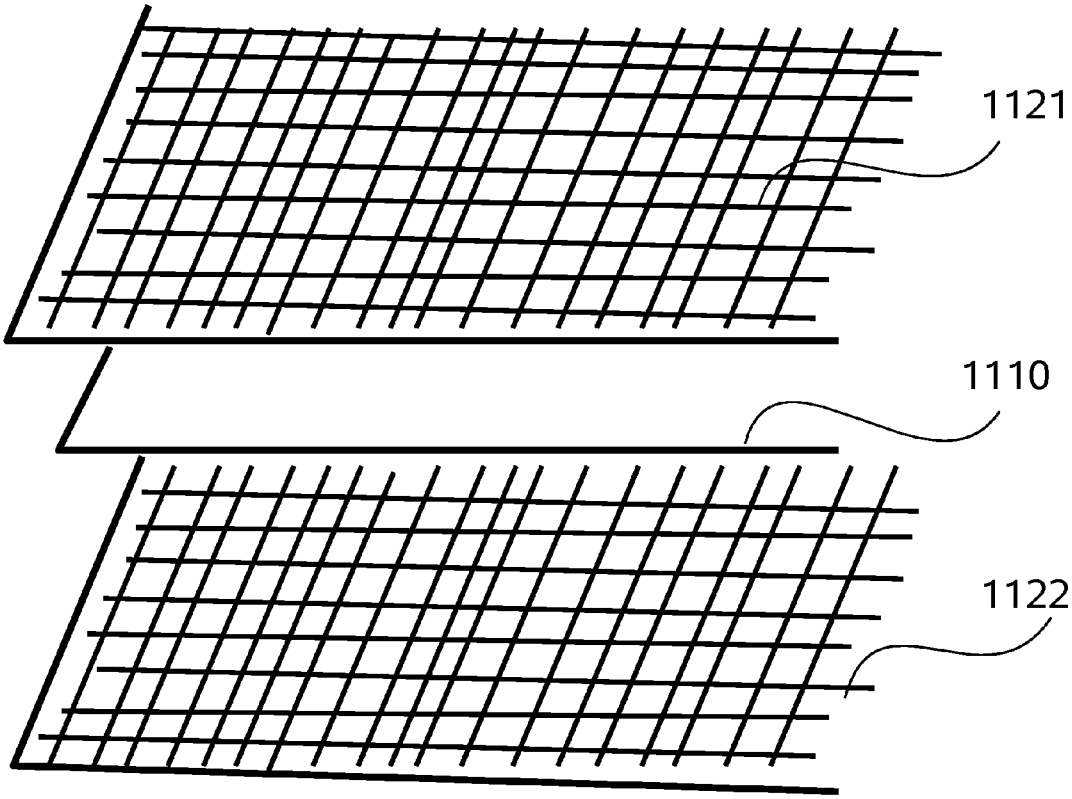
Figure 11B:
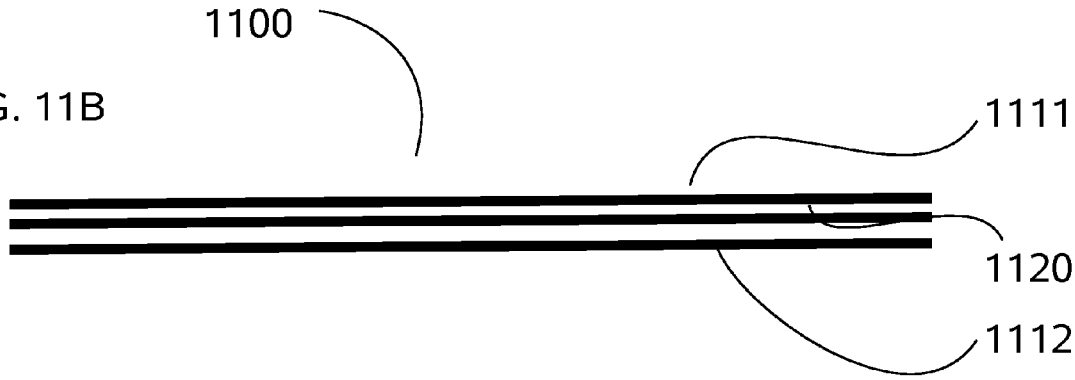
FIG. 11B is a cross-sectional elevation of a related alternative to the fabric shown in FIG. 11A.

FIG. 11A is a schematic exploded perspective view of another alternative elastic fabric 1100 for use in the invention, whereas FIG. 11B is a cross-sectional elevation of a variant of the fabric 1100 shown in FIG. 11A, the former having a central gel layer 1110 covered by an upper (1121) and lower (1122) layers of elastic fabric. The gel layer 1110 provides weigh from the substance it absorbs on swelling, such as water, mineral oil and like substances that are appropriate for occasional skin contact. Layer 1110 being a gel is inherently elastic to the extent permitted by the polymeric nature and cross-link density, whereas the upper and lower layers of elastic fiber 921/922 move with it in response to the user's body movement. In contrast, in FIG. 9B, the fabric 1100 has an elastic fabric layer 1120 covered by an upper (1111) and lower (1112) layers of elastic gel.

FIG. 12A is a schematic perspective view of another alternative elastic fabric 1200 for use in the invention, which is compartmentalized by a quilting or sewing a pattern the pattern of FIG. 12B, in which each quilted compartment 1201 contains a metal button 1210 of a predetermined weight.

Figure 13:
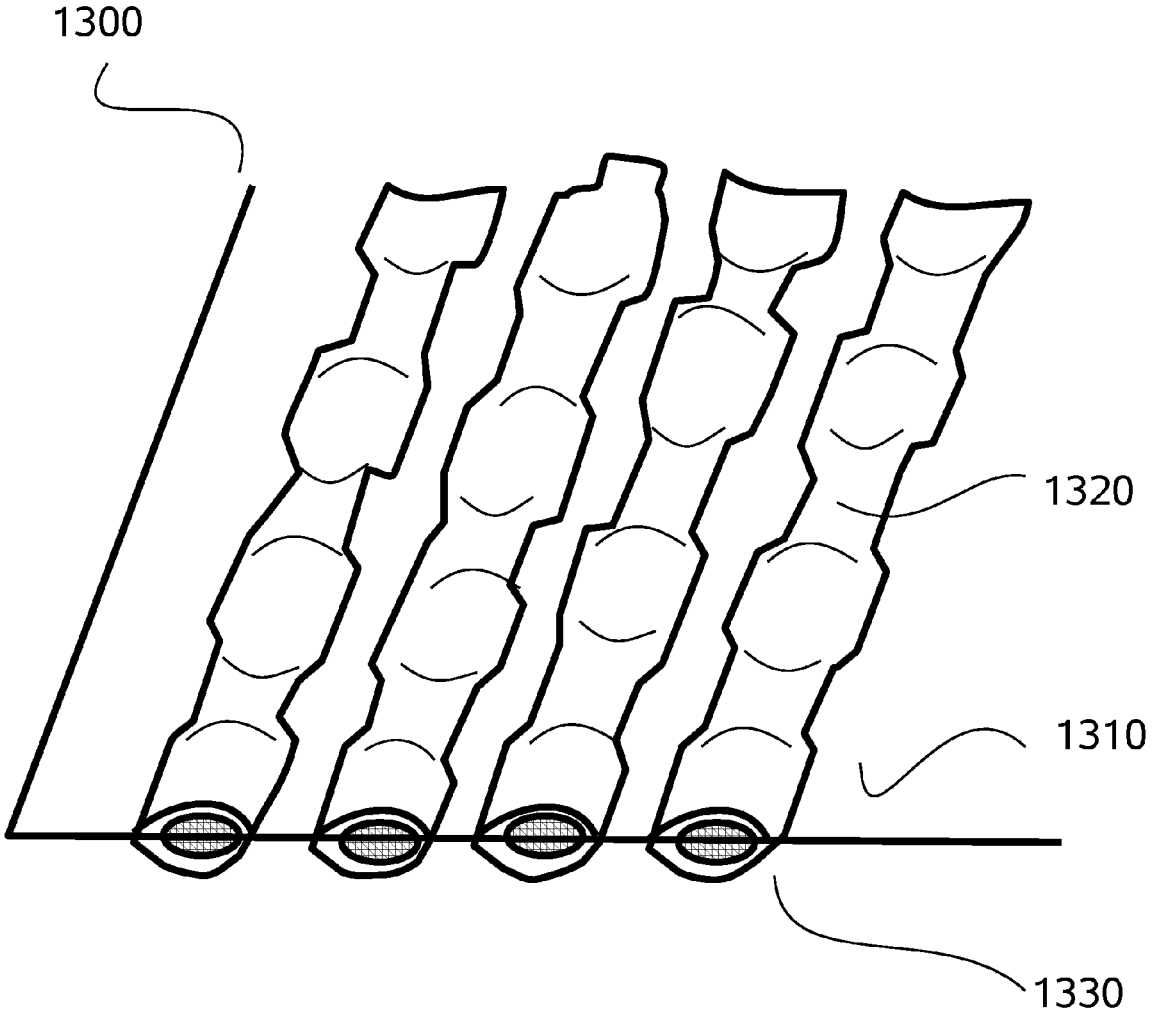
FIG. 13 is a schematic perspective view of another alternative fabric for use in the invention.

FIG. 13 is a schematic perspective view of another alternative elastic fabric 1300 for use in the invention. It comprises at least one layer of an elastic fabric 1310. Elastic tubes 1320 are oriented in generally parallel rows and connected to the fabric 1310, such as by stitching, adhesives and the like. The tubes 1320 modulate in diameter to contain a plurality of metal beads 1330 as weights in a spaced array on fabric 1310. Example 5 below corresponds to this construction.

Figure 14A:
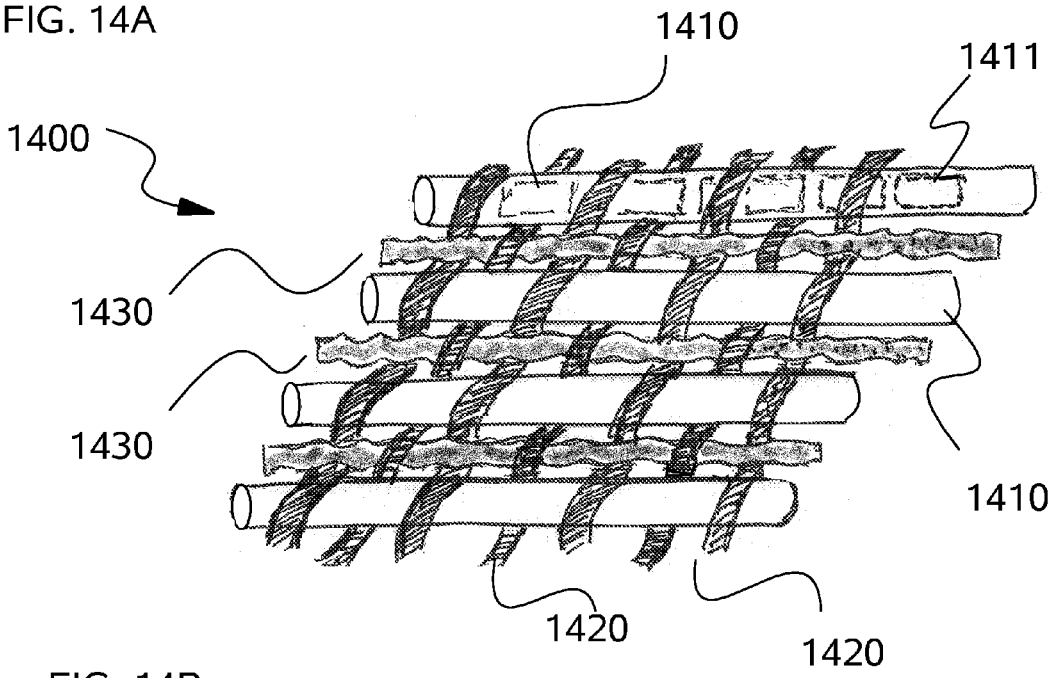
Figure 14B:
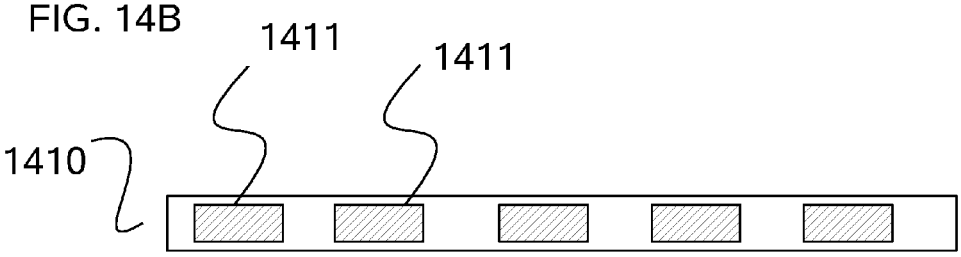
Figure 14C:
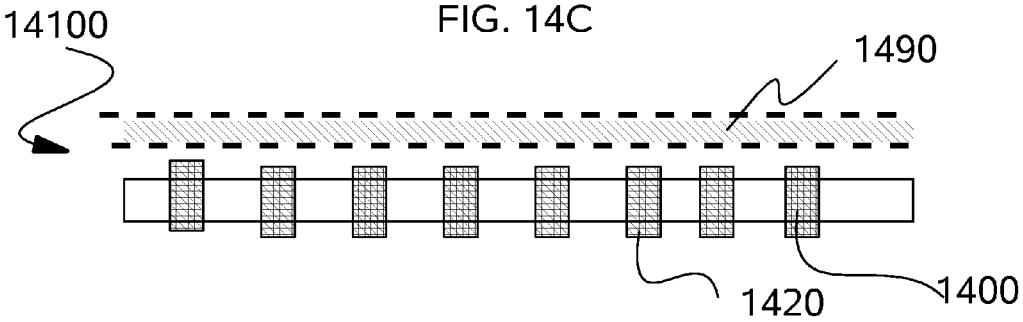

FIG. 14A-C illustrate another alternative fabric 1400 for use in the invention. The elastic fabric is comprised of a woven mesh of elastic tubular threads 1410 containing a plurality of metal beads 1411 as weights in their tubular lumen. The elastic tubular threads 1410 are woven next to each other or in an open mesh (FIG. 14A) with other suitable threads or tapes 1430 to provide a flexible and breathable elastic fabric 1400. The threads or tapes 1430 are preferable a porous tape. The cross fibers in the weave that bind the elongated elastic tubes 1410 are designated 1420, which are preferably elastically stretchable to balance the elasticity of the fabric in both directions. FIG. 14C is a cross-sectional elevation of another embodiment of a fabric 14100 in which fabric 1400 is covered with an elastic fabric layer, which can be as a non-limiting example a fabric of Spandex and 84% Nylon. Example 6 below corresponds to this construction.

Figure 15A:
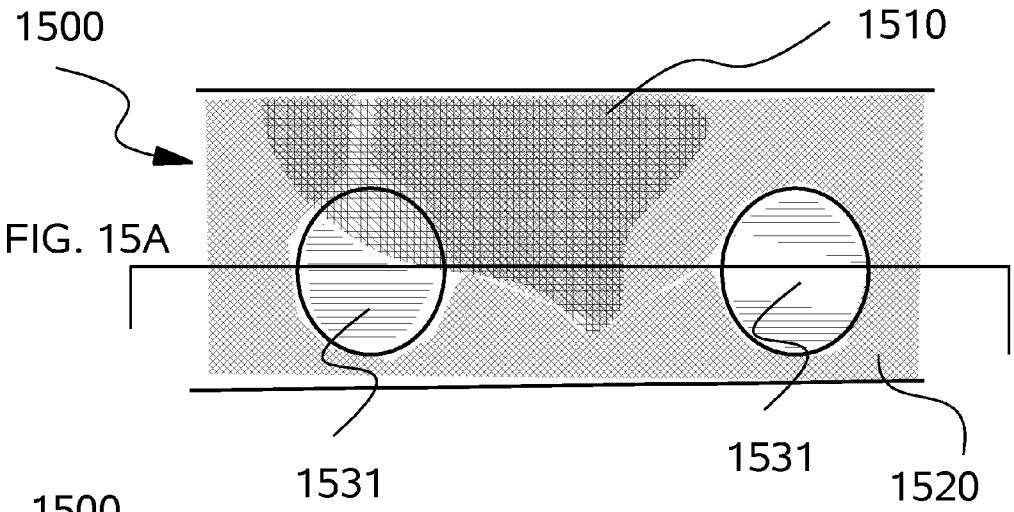
Figure 15B:
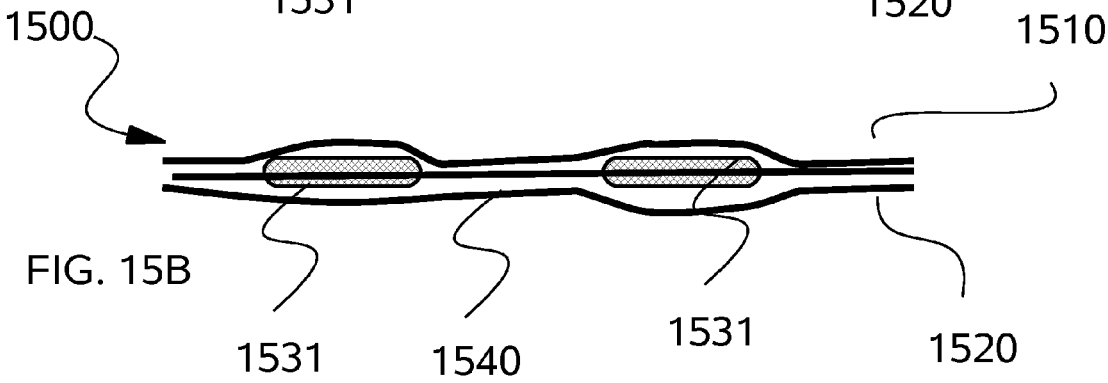
Figure 15C:
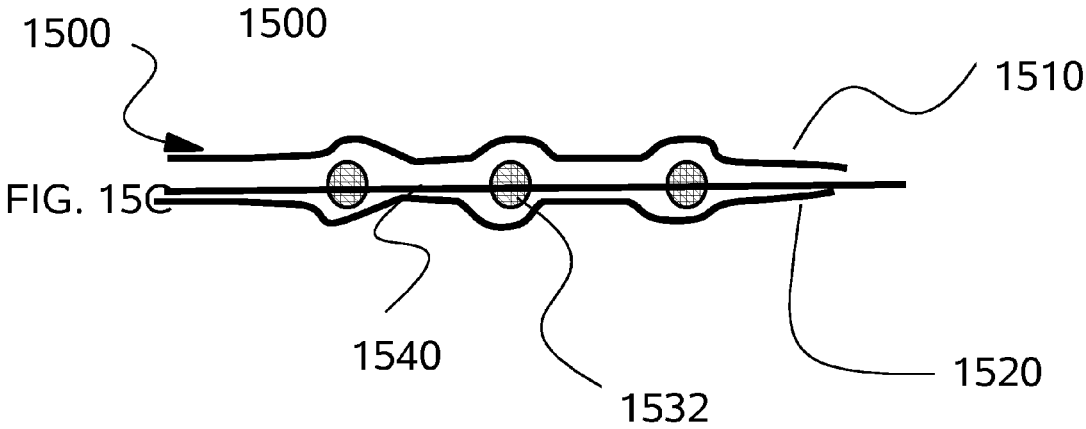
Figure 16A:
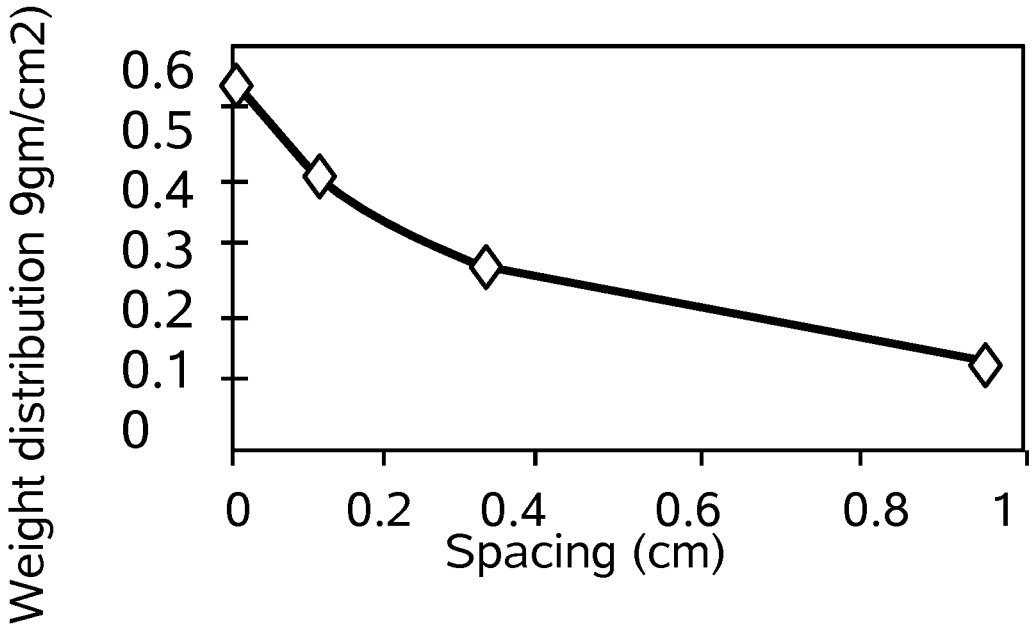
FIG. 16A is a graph illustrating the variation of weight distribution with the spacing of spring weight elements for uniform weight distribution.
Figure 16B:
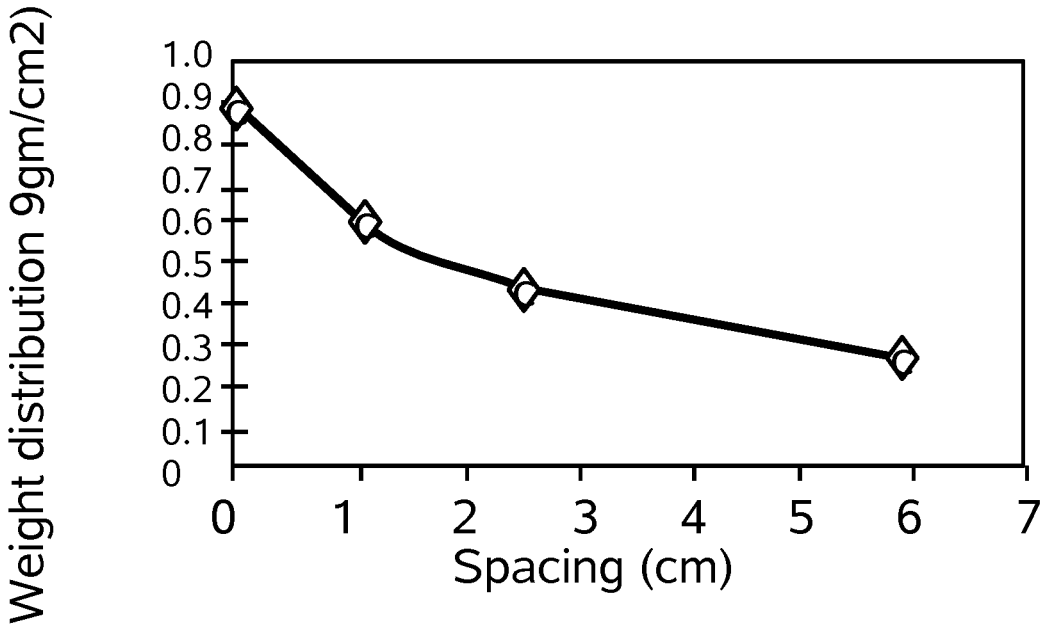
FIG. 16B is graph illustrating the variation of weight distribution with the spacing of button or disc-shaped weight elements for uniform weight distribution.

FIGS. 15A-C are schematic views of another alternative elastic fabric 1500 for use in the invention. The elastic fabric 1500 comprises two layers of an elastic membrane 1510 and 1520 encapsulating one layer comprised of the metallic weights 1531 or 1532 in between the two layers. The elastic membrane is preferably a non-woven fabric. The encapsulated metal weight can be a disk 1531 as shown in FIG. 15A, or a sphere 1532 as shown in FIG. 15B. The two layers 1510 and 1530 are connected to each by local fusion under compression, ultrasonic welding, adhesives and the like into a flexible and porous weighted membrane. The weights 1531 or 1532 are optionally discrete as shown in FIG. 15A, or connected to each other, as shown in FIGS. 15B and C, by a wire, fiber, thread, tape or the like, which is designated 1540. It should understood that the fabric can be formed of woven or non-woven fibers, a non-woven fabric being any such fabric wherein fibers are connected to other fibers by a means instead or in addition to weaving, such as fusion bonding, welding, gluing and the like. Examples 7 corresponds to this construction. As used herein the term fabric is also intended to embrace thin porous membranes that are flexible, and hence can flex, bend, distort and stretch in a similar manner to woven and non-woven fabrics.

Alternatively, weights 130 are optionally metallic tapes. Such metallic tapes are optionally woven through an open flexible mesh that can attach to or from the inner garment 120.

Weights 130 and foam padding 150 are optionally integrated in one or more units that are detachable from the inner garment to enable independent washing of each garment or the weight bearing outer layer or the lining detached there from. Alternatively, the weights 130 can be chain mail and mesh used for example in butchers protective gloves.

The deployment of springs and buttons or discs results in differences in weight distribution, in-homogeneity and weight distribution depending on the size and spacing. We considered the above variables when the weight element is a linear spring and also when it is a disc-shaped button. For either case, we consider that the cloth material is fully loaded when the weight elements are very close next to each other, touching but acting independently. So, in the case of springs, e.g. with diameter 0.125" (about 3.2 mm), there will be 8 springs next to each other over the length of one inch for full loading, 4 springs for 50% loading, 6 spring for 75% loading and 2 springs for 25% loading. If we consider that the springs are spaced equally from each other, the spacing will change with the degree of loading. Also, the weight distribution with reference to the total surface area of the body will also change. The total surface area of the human body is 1.6-1.9 $m^2$. For the purposes of this invention, we assume that the total area of the body that is covered is about 1.4 $m^2$ since certain areas of the human body such as the head and extremities of limbs will not be covered. Considering that the spacing between the weight elements is kept the same, the weight distribution is uniform at all times although it is reduced as the spacing increases.

In the case of the disc-shaped buttons e.g. having diameter 1", ten buttons will cover a length of 10 inches for complete covering, 5 buttons spaced one inch apart for 50% loading, 7 buttons for 75% loading and 3 buttons for 25%. As above. Likewise, the distance between adjacent buttons can be related to the weight distribution, assuming that the buttons are at equal distances from each other.

The following Tables 1 and 2 and the corresponding graphs in FIGS. 14A and 14B below show the variation of the weight distribution with the spacing between the weight elements for these alternative weight elements, spring and buttons. The weight distribution, while uniform at all times, is reduced faster at first and then slower as the distance between the weight elements increases. The rate of the reduction of the weight distribution with distance depends on the geometrical profile of the weight elements, it changes more rapidly and over shorter distances for the spring weight elements.

TABLE 1

Variation of Spacing of Spring Weight Elements and Weight Distribution with Surface Coverage

| Coverage (%) | No. Springs/in. | Spacing (cm) | Weight distribution ($g/cm^2$) |
|---|---|---|---|
| 100 | 8 | 0 | 0.548 |
| 75 | 6 | 0.106 | 0.411 |
| 50 | 4 | 0.317 | 0.274 |
| 25 | 2 | 0.95 | 0.137 |

(notes to table 1:
Weight element = Spring, Spring Weight = 15.9 g Spring Surface Area = 29 $cm^2$ Diameter = 0.125" (0.317 cm) and Spring Weight per in2 = 3.556 g

TABLE 2

Variation of Spacing of Disc-shaped Weight Elements and Weight Distribution with Surface Coverage

| Coverage (%) | No. Springs/in. | Spacing (cm) | Weight distribution ($g/cm^2$) |
|---|---|---|---|
| 100 | 100 | 0 | 0.88 |
| 75 | 70 | 1.06 | 0.61 |
| 50 | 50 | 2.54 | 0.44 |
| 25 | 30 | 5.92 | 0.26 |

(Notes to Table 2:
Weight Element = Disc-shaped button, Button Weight = 5.7 g Button Surface Area = 5.06 $cm^2$, and Button Diameter = 1 in (2.54 cm)

The weight distribution uniformity will be reduced when the spacing between the elements is not the same depending also on diversity of the spacing. In this situation, the weighted clothing can be envisaged to have "weight in-homogeneities" in it. The effect can be minimized by randomizing these in-homogeneities or balancing the equal distance factor and the weight and shape of the weight elements.

In relation to the uniform weight distribution, we considered also the amount of the weight that can be applied on certain parts of the body such as arms, fore-arms and legs, which have a limited surface area. These calculations for different weights conditions, surface areas of different parts of the body enable broadest application various embodiments of this invention to be useful to broad range of users, such as from the older and physically weaker to physically fit athletes. Ideally, a weighted clothing material needs to be able to deliver at any part of the body a uniform weight distribution of at least 0.06 g/cm2. The uniform weight distribution can be adjusted by balancing the equal distance factor and the weight and shape of the weight elements to be higher at a particular part of the body for example, for training or rehabilitation purposes.

In order to maximize the contact area of the fabric to the body for the better weight distribution over the body surface, the elastic component needs to be capable of compensating the weight distribution that is used. Thus, it needs to support the minimum weight distribution condition and of course any higher weight distribution that is used.

EXAMPLES

Without diminishing the usefulness of a particular kind or group of materials, material compositions or constructions, we chose to use cloth fabrications incorporating the metal spring cables and metal disc or buttons for demonstrating the usefulness of the gravity assist clothing of this invention. As an underlying fabric we used an elastic fabric made of natural and synthetic fibers and containing "Spandex™" brand fabric.

Example 1

In one example a weighted fabric exhibiting the features of this invention was prepared using an elastic fabric made of Spandex and 84% Nylon™ and incorporating linear spring cables with a diameter of about 3.2 mm and weight of about 17 g per m by sewing the springs next to each other with a spacing of 3 mm. The resultant fabric was flexible, stretchable and had a weight distribution of about 0.284 g/cm2 that was uniformly distributed though out the surface of the fabric.

Example 2

In another example a weighted fabric exhibiting the characteristics of Example 1 and having each linear spring covered completely by elastic fabric was prepared by laying the linear spring cables between two elastic fabrics made of Spandex and 84% Nylon and sewing the two fabrics together between the adjacent linear spring cables to cause the cloth covering (known as piping) of each spring by the two fabric layers.

It should be noted that the fabric of examples 1 and 2 may be deployed in the embodiments of the invention indicated in FIGS. 1A and 1B, FIG. 4 and FIG. 6A-C

Example 3

In another example a weighted fabric exhibiting the features of this invention was prepared using an elastic fabric made of Spandex and 84% Nylon and sewing onto it tubular tapes made of the same elastic fabric containing flat metal steel buttons having 2.54 cm diameter and weighing about 5.7 g that were laid next to each other and kept separated by sewing lines along the length of each tubular tape. The tubular tapes were sewed very close next to each other, the combined fabric construction emulating a flexible and stretchable quilt that had a weight of about 11.3 kg and a weight distribution of 0.8 g/cm$^2$ that was uniformly distributed throughout the surface of the fabric.

Example 4

In another example we used a pre-fabricated elastic suit made of Spandex and 84% Dacron to prepare a weighed suit with uniform weight distribution. The weight components were metal spring cables made of stainless steel and had a diameter of about 3.2 mm and weight of about 17 g per m as in Example 1. The spring cables were incorporated onto the fabric by sewing them at regular intervals of about 3 mm result in a suit with a weight of about 4 kg and a weight distribution of about 0.286 g/cm$^2$.

Example 5

In another example we prepared a weighted suit weighing about 11.5 kg using a prefabricated elastic suit made of Spandex and 84% Dacron and incorporating tubes of elastic fabric containing metal beads with diameter of 2 mm. The tubing of the elastic fabric with the metal beads in it had a weight of 33.4 g/m and was sewed on the elastic fabric with a spacing of about 2 mm between adjacent tubes. Like the spring cables, the elastic tubing with the metal beads in it was stretchable and flexible. Such elastic tubing can be made of elastic fibers by braiding, and processed further by weaving techniques.

Example 6

In another example we prepared a weighted suit weighing about 8.2 kg using an elastic fabric of Spandex and 84% Nylon as an outer layer that was connected to an inner lining comprising a woven fabric made of braided tubes containing metal beads with diameter of 2 mm, The metal beads were inserted into the braided tubes, which had a relaxed or initial outer diameter of about 3.2 mm, and a wall thickness of about 1 mm. Further, cotton tapes were interwoven between these braided tubes. The braided tubing had a weight of 33.4 g/m. Woven fabrics of braided tubing with metal weights and cotton tapes were interwoven with different spacing to provide for enhanced breathability and flexibility.

The Spandex/Nylon or comparable elastic fabric outer layer can be attached to inner lining by stitching, bonding, gluing and the like, and preferably covers the weighted fabric so they expand in uniform way, and can be used as a single fabric to form the weighted garment.

It should be understood that the various weighted fabrics that deploy weight containing fibers, tubes, treads can be interwoven with similar members that do not container weight to facilitate bonding at seams. Such interweaving can be done with other materials or a different elastic fabric. Similarly, by interweaving non weighted components between the metal components can facilitate cutting, including laser cutting, as well as facilitate providing seam attachment portions that can easily be stitched.

Example 7

In another example a non woven weighted fabric exhibiting the features of this invention was prepared by encapsulating the metal weights between porous polyethylene membranes by thermally compressing two membranes about 250 micron thick against the metal weights (disc shaped having about 12 mm diameter) that were placed with certain spacing on one of the two membranes. The two membranes were joined by thermal compression. Various joining techniques and means are available for joining the membranes in different patterns to preserve the porosity and flexibility of the nonwoven weighted fabric.

It should be understood that alternative embodiment of the invention may deploy any combination of the weighted elastic cloth or fabric materials disclosed herein. For training purpose, additional weight clothe layers can be added, or in some embodiments more weights can be added to an existing cloth or fabric.

In summary, use of the various and preferred embodiment of the inventive athletic garment provide the benefits of muscle strengthening, bone strengthening, enhanced cardiac performance and weight loss.

The preferred embodiments of the athletic garment generally offer the combination of being body conformable, comfortable, washable, breathable, adjustable weight, foldable and easy to dress and undress.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. A wearable garment system that comprises:

a. an outer shell fabric adapted to fit at least one of a person's leg and the torso and arms, b. an inner lining detachable from the outer shell, c. detachable weights coupled to the inner lining, d. wherein the detachable weights are distributed in multiple position between at least the joints of limbs and the torso so as to not interfere with the drape of the outer shell in that would otherwise occur in the absence of the inner lining wherein the detachable weights are a plurality of metallic springs and further wherein inner lining is an elastic fabric and said metallic springs are uniformly dispersed within and coupled to the elastic fabric to enable biaxial stretching the inner lining.

2. A wearable garment system according to claim 1 wherein the detachable weights do not interfere with the elastic properties of the fabric.

3. A wearable garment system according to claim 1 wherein the detachable weights provides a weight distribution of at least 0.2 g/cm2.

4. A wearable garment system according to claim 1 wherein the detachable weights provides a weight distribution of at least 0.5 g/cm2.

5. A fabric comprising:

a. an elastic fabric;

b. a metallic weighting component integrally joined to the elastic fabric by uniformly dispersed weights to avoid interfering with the elastic properties of the fabric, wherein the weights are inside a discrete elastic elongated enclosures attached to elastic fabric with an adhesive.

6. A fabric according to claim 5 having a weight distribution of at least 0.2 g/cm2.

7. A fabric according to claim 5 having a weight distribution of at least 0.5 g/cm2.

8. A fabric according to claim 5 wherein the weights are selected from the group consisting of spring and buttons.

9. A fabric according to claim 5 wherein the weights are discrete beads inside the elastic elongated enclosures attached to elastic fabric.

10. A fabric comprising:

a. a plurality of elastic elongated enclosures extending in a first direction, the elastics elongated enclosures having a lumen which contains a plurality of spaced apart weights, b. a plurality of elongated spacing members, each extending in the first direction being disposed between each of the adjacent elastic elongated enclosures, c. a plurality of cross-fibers extending generally perpendicular to the first direction being interwoven with the plurality of elastic elongated enclosures and elongated spacing members to bind said elastic elongated enclosures and elastic spacing members together to form the fabric.

11. A fabric according to claim 10 that further comprises an attached planar covering of an elastic fabric.

12. A fabric according to claim 5 wherein the weights are selected from the group consisting of disks and balls.

13. A garment formed from a fabric comprising:

a. a fabric layer, b. a plurality of discrete adjacent elastic elongated enclosures extending in a first direction parallel to each other being disposed on and connected to the fabric layer by an adhesive, c. a plurality of spaced apart weights disposed within the lumen defined by an interior wall of the elastic elongated enclosures.

14. The garment according to claim 13 in which the distance between adjacent elastic elongated enclosures is equal to a width of the elastic elongated enclosures.

15. The garment according to claim 13 in which the elastic elongated enclosures have a width of about 2 mm.

16. The garment according to claim 13 in which the elastic elongated enclosures are woven.

17. The garment according to claim 13 in which the elastic elongated enclosures are woven from elastic fibers.

18. The garment according to claim 13 in which the elastic elongated enclosures is formed from braided elastic fibers.

19. A wearable garment system that comprises:

a. A weighted elastic fabric comprising one or more layers of woven and non-woven materials including adhesives bondable by thermo-mechanical means, b. A plurality of weights that are an integral part of fabric and are dispersed uniformly within the fabric, being encapsulated between elastic surrounding layers c. wherein the weights are distributed in multiple position between at least the joints of limbs and the torso so as to not interfere with the biaxial stretching of the fabric and with the natural body movements that would otherwise occur in the absence of the wearable garment system.

20. A wearable garment comprising:

a. an elastic fabric comprising;

i. one or more layers of at least one of a woven and non-woven materials;

ii. a plurality of regularly spaced apart encapsulated weights, between adjacent layers, ii. wherein said fabric provides the garment with a field of weight characterized by uniformly spaced weights separated by a spacing of up to about 5.92 cm to provide a weight distribution at least about 0.26 $g/cm^2$.

21. The wearable garment according to claim 20 wherein said fabric provides the garment with a field of weight characterized by uniformly spaced weights separated by a spacing of up to about 0.95 cm to provide a weight distribution at least about 0.137 $g/cm^2$.

22. A fabric according to claim 5 wherein the weights are buttons inside the elastic elongated enclosures and are attached to elastic fabric with an adhesive.

23. A garment formed from a fabric comprising:

a. an elastic fabric;

b. a weighting component integrally joined to the elastic fabric by uniformly dispersed weights to avoid interfering with the elastic properties of the fabric wherein the weights are inside discrete enclosures attached to the elastic fabric with an adhesive.

* * * * *